US009005684B2

(12) United States Patent
Baron

(10) Patent No.: US 9,005,684 B2
(45) Date of Patent: Apr. 14, 2015

(54) DRINKING STRAW WITH INTEGRAL FILTERS

(75) Inventor: Peter Baron, New South Wales (AU)

(73) Assignee: Unistraw Patent Holdings Limited, Labuan (MY)

( * ) Notice: Subject to any disclaimer, the term of this patent is extended or adjusted under 35 U.S.C. 154(b) by 0 days.

(21) Appl. No.: 13/478,699

(22) Filed: May 23, 2012

(65) Prior Publication Data

US 2012/0228400 A1 Sep. 13, 2012

Related U.S. Application Data

(63) Continuation of application No. 12/281,439, filed as application No. PCT/AU2007/000265 on Mar. 2, 2007, now abandoned.

(30) Foreign Application Priority Data

Mar. 2, 2006 (AU) ..... 2006901056

(51) Int. Cl.
*A47G 21/18* (2006.01)

(52) U.S. Cl.
CPC ..... *A47G 21/183* (2013.01)

(58) Field of Classification Search
CPC ... A47G 21/183; A47G 21/18; A47G 21/185; A47G 21/188
USPC ..... 426/85; 239/33
See application file for complete search history.

(56) References Cited

U.S. PATENT DOCUMENTS 1,000,332 A 8/1911 Dyer
1,012,193 A 12/1911 Deffner (Continued)

FOREIGN PATENT DOCUMENTS

BE 884962 A1 12/1980
CN 2305117 Y 1/1999

(Continued)

OTHER PUBLICATIONS

Tetra Pak launches sensory straw, Jan. 20, 2003, Food Production daily.com, retrieved on Jun. 15, 2014. Retrieved from the Internet: URL:<http://www.foodproductiondaily.com/Packaging/Tetra-Pak-launches-sensory-straw>.*

(Continued)

*Primary Examiner* — Rena L Dye
*Assistant Examiner* — Chaim Smith
(74) *Attorney, Agent, or Firm* — Mintz Levin Cohn Ferris Glovsky and Popeo, P.C.

(57) ABSTRACT

A drinking straw for progressively adding an active ingredient to a carrier liquid as the liquid is drawn through the straw. The straw includes a generally elongate tubular body having an internal bore and a sidewall. The tube includes first and second filters and disposed at respective first and second ends and, of the tube. Together, the first and second filters retain a predetermined measure of soluble active ingredients within the bore of the tube, while allowing a carrier liquid to be drawn through the straw, by oral suction. The active ingredient, takes the form of a plurality of solid pellets. Each filter is formed by blocking, closing or constricting the tube at or adjacent the corresponding end and providing at least one aperture sized to be sufficiently small to retain the pellets within the tube whilst sufficiently large to allow passage of liquid.

18 Claims, 7 Drawing Sheets

(56) References Cited

U.S. PATENT DOCUMENTS

| | | | |
|---|---|---|---|
| 1,254,115 | A | 1/1918 | Brand |
| 1,333,011 | A | 3/1920 | Crady |
| 1,821,551 | A | 9/1931 | Kennedy |
| 1,996,203 | A | 4/1935 | Hollingsworth |
| 2,102,920 | A | 12/1937 | Savage |
| 2,128,448 | A | 8/1938 | Wright |
| 2,436,505 | A | 2/1948 | Du Rall |
| 2,812,257 | A | 11/1957 | Scisorck |
| 2,867,536 | A | 1/1959 | Mead et al. |
| 2,901,357 | A | 8/1959 | Epstein |
| 2,943,794 | A | 7/1960 | Sussman |
| 3,138,249 | A | 6/1964 | Paulini |
| 3,398,624 | A | 8/1968 | Stoessel et al. |
| 3,438,527 | A | 4/1969 | Gamblin |
| 3,610,483 | A | 10/1971 | Visconti et al. |
| 3,615,595 | A | 10/1971 | Guttag |
| 3,620,770 | A | 11/1971 | Harvey |
| 3,717,476 | A | 2/1973 | Harvey |
| 3,730,737 | A | 5/1973 | Harvey et al. |
| 3,824,322 | A | 7/1974 | Fiorella |
| 4,076,847 | A | 2/1978 | Johnson et al. |
| 4,298,475 | A | 11/1981 | Gartner |
| 4,789,546 | A | 12/1988 | Medri |
| 4,792,333 | A | 12/1988 | Kidder |
| 4,800,089 | A | 1/1989 | Scott |
| 4,921,713 | A | 5/1990 | Fowler |
| 4,981,468 | A | 1/1991 | Benefiel et al. |
| 4,981,698 | A | 1/1991 | Cherukuri et al. |
| 4,995,976 | A | 2/1991 | Vermes et al. |
| 5,045,195 | A | 9/1991 | Spangrud et al. |
| 5,052,614 | A | 10/1991 | Xuan |
| 5,094,861 | A | 3/1992 | D'Auguste et al. |
| 5,156,335 | A | 10/1992 | Smith et al. |
| 5,156,737 | A | 10/1992 | Iana et al. |
| 5,201,460 | A | 4/1993 | Caines |
| 5,433,962 | A | 7/1995 | Stipp |
| 5,478,592 | A | 12/1995 | Kingsley et al. |
| 5,509,605 | A | 4/1996 | Cripe |
| 5,601,207 | A | 2/1997 | Paczonay |
| 5,718,681 | A | 2/1998 | Manning |
| 5,766,194 | A | 6/1998 | Smith |
| 5,780,058 | A | 7/1998 | Wong et al. |
| 5,792,473 | A | 8/1998 | Gergely et al. |
| 5,910,321 | A | 6/1999 | Wong et al. |
| 5,921,955 | A | 7/1999 | Mazer et al. |
| 5,965,165 | A | 10/1999 | Zannini et al. |
| 5,985,324 | A | 11/1999 | Wong et al. |
| 5,989,590 | A | 11/1999 | Wong et al. |
| 6,024,721 | A | 2/2000 | Wong et al. |
| 6,106,845 | A | 8/2000 | Wong et al. |
| 6,109,538 | A | 8/2000 | Villani et al. |
| 6,136,345 | A | 10/2000 | Grimmett et al. |
| 6,231,900 | B1 | 5/2001 | Hanke |
| 6,283,294 | B1 | 9/2001 | Thorball et al. |
| 6,322,818 | B1 | 11/2001 | Rebier |
| 6,375,091 | B1 | 4/2002 | Cha |
| 6,460,777 | B2 | 10/2002 | Float et al. |
| 6,482,451 | B1 | 11/2002 | Baron |
| D487,375 | S | 3/2004 | Bengtsson et al. |
| 6,783,783 | B2 | 8/2004 | Clark et al. |
| D497,509 | S | 10/2004 | Nelson |
| D497,764 | S | 11/2004 | Nelson |
| 7,040,547 | B1 | 5/2006 | Nelson |
| D550,496 | S | 9/2007 | Stribling et al. |
| 7,354,007 | B2 | 4/2008 | Pearson |
| D578,333 | S | 10/2008 | Baron |
| 7,452,558 | B2 | 11/2008 | Jani et al. |
| D602,726 | S | 10/2009 | Baron |
| 2001/0014376 | A1 | 8/2001 | Saint-Ramon et al. |
| 2003/0087005 | A1* | 5/2003 | Baron ..... 426/85 |
| 2003/0203075 | A1 | 10/2003 | Taylor |
| 2006/0065757 | A1 | 3/2006 | Calabrese |
| 2007/0034708 | A1 | 2/2007 | Pearson |
| 2009/0041904 | A1 | 2/2009 | Baron |
| 2010/0159075 | A1 | 6/2010 | Baron |

FOREIGN PATENT DOCUMENTS

| | | | | |
|---|---|---|---|---|
| CN | 2328281 | Y | 7/1999 | |
| CN | 2330264 | Y | 7/1999 | |
| DE | 3731058 | A1 | 4/1989 | |
| DE | 29616646 | U1 | 12/1996 | |
| EP | 0584594 | A1 | 3/1994 | |
| EP | 0670160 | A1 | 9/1995 | |
| FR | 1176877 | A | 4/1959 | |
| GB | 760428 | A | 10/1956 | |
| GB | 2168027 | A | 6/1986 | |
| GB | 2 198 622 | * | 6/1998 | ..... A47G 21/18 |
| GB | 2366178 | A | 3/2002 | |
| HU | 3175 | U | 10/2006 | |
| HU | 3203 | U | 12/2006 | |
| JP | 59118113 | A | 7/1984 | |
| JP | 59114073 | U | 8/1984 | |
| JP | 60003466 | A | 1/1985 | |
| JP | 63007768 | A | 1/1988 | |
| RU | 2136561 | C1 | 9/1999 | |
| WO | WO-9703634 | A1 | 2/1997 | |
| WO | WO-9815187 | A1 | 4/1998 | |
| WO | WO-03079957 | A1 | 10/2003 | |
| WO | WO-03079958 | A1 | 10/2003 | |
| WO | WO-03101226 | A1 | 12/2003 | |
| WO | WO-04000203 | A1 | 12/2003 | |
| WO | WO-2007098564 | A1 | 9/2007 | |
| WO | WO-2008055296 | A1 | 5/2008 | |

OTHER PUBLICATIONS

"Unistraw takes Nestlé to High Court." thegrocer.co, Jan. 14, 2006. Retrieved Mar. 15, 2011. http://www.thegrocer.co.uk/articles.aspx?page-articles&ID=106825.

AG1—Packing artwork for Felföldi's "Super Candy" Dragees Drink dated Oct. 14, 1997, submitted in *Unistraw International Limited* v *Felföldi Potpourri Kft*., Mar. 26, 2008.

AG23-AG25—Photograph and packing artwork for Felföldi's "Master Cow" Magic Straw, submitted in *Unistraw International Limited* v *Felföldi Potpourri*, Apr. 18, 2008.

AG29—Affidavit of József Felföldi executed Apr. 24, 2008 and English translation, submitted in *Unistraw International Limited* v *Felföldi Potpourri Kft*., Apr. 28, 2008.

AG7—Packing artwork for Felföldi's "Master Cow" Magic Straw, submitted in *Unistraw International Limited* v *Felföldi Potpourri Kft*., Mar. 26, 2008.

Certificate of Registration for Community Design No. 000422829-0001, Community Designs Bulletin No. 2005/114, Nov. 29, 2005. http://oami.europa.eu.

Certificate of Registration for Community Design No. 000422829-0002, Community Designs Bulletin No. 2005/114, Nov. 29, 2005. http://oami.europa.eu.

Certificate of Registration for Community Design No. 000575063-0001, Community Designs Bulletin No. 2006/102, Sep. 12, 2006. http://oami.europa.eu.

Certificate of Registration for Community Design No. 000575063-0002, Community Designs Bulletin No. 2006/102, Sep. 12, 2006. http://oami.europa.eu.

Certificate of Registration for Community Design No. 000784053-0001, Community Designs Bulletin No. 2007/164, Nov. 12, 2007. http://oami.europa.eu.

Certificate of Registration for Community Design No. 000784053-0002, Community Designs Bulletin No. 2007/164, Nov. 12, 2007. http://oami.europa.eu.

Certificate of Registration for Community Design No. 000784053-0003, Community Designs Bulletin No. 2007/164, Nov. 12, 2007. http://oami.europa.eu.

Certificate of Registration for Community Design No. 000784053-0004, Community Designs Bulletin No. 2007/164, Nov. 12, 2007. http://oami.europa.eu.

Certificate of Registration for Community Design No. 000784053-0005, Community Designs Bulletin No. 2007/164, Nov. 12, 2007. http://oami.europa.eu.

(56) References Cited

OTHER PUBLICATIONS

Certificate of Registration for Community Design No. 000784053-0006, Community Designs Bulletin No. 2007/164, Nov. 12, 2007. http://oami.europa.eu.

Certificate of Registration for Community Design No. 000784053-0007, Community Designs Bulletin No. 2007/164, Nov. 12, 2007. http://oami.europa.eu.

Certificate of Registration for Community Design No. 000784053-0008, Community Designs Bulletin No. 2007/164, Nov. 12, 2007. http://oami.europa.eu.

Certificate of Registration for Community Design No. 000784053-0009, Community Designs Bulletin No. 2007/164, Nov. 12, 2007. http://oami.europa.eu.

Certificate of Registration for Community Design No. 000935820-0001, Community Designs Bulletin No. 2008/170, Aug. 19, 2008. http://oami.europa.eu.

Certificate of Registration for Community Design No. 000935820-0002, Community Designs Bulletin No. 2008/170, Aug. 19, 2008. http://oami.europa.eu.

Certificate of Registration for Community Design No. 000935820-0003, Community Designs Bulletin No. 2008/170, Aug. 19, 2008. http://oami.europa.eu.

Communication pursuant to Article 96(2) EPC issued in European Application No. 03724637.8, dated May 7, 2007.

Magic Straw picturse, retrieved from gotchocolate.com on Mar. 15, 2011. http://www.gotchocolate.com/2010/10/review-got-milk-co-coa-magic-milk-straws/.

Notice of Opposition to a European Patent issued in European Application No. 03724637.8, dated Dec. 10, 2008.

Notice of Opposition to a European Patent issued in European Application No. 03724637.8, dated Dec. 17, 2008.

Quick Milk Magic Straws, retrieved from perpetualkid.com on Mar. 16, 2011. http://www.perpetualkid.com/quick-milk-magic-straw.aspx.

Response to Communication pursuant to Rule 79(1) EPC issued in European Patent No. 1509096, dated Mar. 16, 2010.

Response to the Communication pursuant to Article 96(2) EPC issued in European Application No. 03724637.8, dated Sep. 11, 2007.

Tetra Pak brochure, Sensory Straw, A Sensational Drinking Experience, 2002.

* cited by examiner

DRINKING STRAW WITH INTEGRAL FILTERS

CROSS-REFERENCE TO RELATED APPLICATIONS

This application is a continuation of U.S. patent application Ser. No. 12/281,439, filed Sep. 2, 2008, which is a national phase of International Application No. PCT/AU2007/000265, filed Mar. 2, 2007, which claims priority to Australian Patent Application No. 2006901056, filed Mar. 2, 2006. The entire disclosures of each of the above applications are incorporated herein by reference.

FIELD OF THE INVENTION

The present invention relates generally to a method and apparatus for the addition of soluble agents or ingredients to a carrier liquid, at the point of consumption, for oral administration through a straw.

The invention has been developed primarily for use in relation to the flavouring of pre-packaged or bottled beverages such as milk, and will be described with reference to this application. It will be appreciated, however, that the invention is not limited to this particular use and may be also used to provide flavouring or colouring to other beverages, or for the oral administration of soluble nutritional, pharmaceutical, health or energy enhancing agents.

BACKGROUND OF THE INVENTION

The following discussion of the prior art is provided as technical background, to enable the features and benefits of the invention to be fully appreciated in an appropriate technical context. However, any reference to the prior art should not be taken as an express or implied admission that such art is widely known or forms part of common general knowledge in the field.

It is known in the art to use soluble pellets or granules, retained by perforated end caps within an elongate tubular body in the form of a straw, to progressively disperse flavouring agents or other ingredients into a carrier liquid drawn through the straw by oral suction, at the point of consumption. Application WO 98/15187 discloses one such device. However, such straws may be unnecessarily complicated and too costly to produce, particularly in disposable form.

It is an object of the present invention to overcome or substantially ameliorate one or more of the limitations of the prior art, or at least to provide a useful alternative.

DISCLOSURE OF THE INVENTION

Accordingly, in a first aspect, the invention provides a method of manufacturing a drinking straw adapted progressively to add an active ingredient to a carrier liquid drawn through the straw, said method including the steps of:

providing a generally elongate tube having a sidewall defining an internal bore and first and second open ends;

providing a first filtration means adjacent the first end of the tube;

depositing a plurality of pellets containing a measure of soluble active ingredient into the tube through the second end; and providing second filtration means adjacent the second end of the tube, wherein said first and second filtration means retain the pellets substantially within the tube whilst allowing the carrier liquid to be drawn through the tube by oral suction and wherein at least one of said filtration means is provided by forming the to sidewall adjacent the respective end of the tube into filtration means.

The terms "dissolved", "soluble" and the like as used herein are intended to be construed sufficiently broadly to encompass not only dissolution in the strict chemical sense, but also suspensions and mixtures with the carrier liquid.

It will be appreciated that the steps presented above may not necessarily be performed in the order recited. Furthermore, the terminology "first end" and "second end" are entirely arbitrary and applied merely to differentiate the ends of the straw rather than an order of steps performed.

Preferably the tube is generally circular in cross-section.

Preferably, the method includes forming the sidewall adjacent both ends of the straw into filtration means.

Preferably, the step of forming each of the respective open ends into filtration means includes the further steps of at least partially blocking the respective end, and forming perforations in the blocked end.

More preferably, each open end of the tube is blocked by clamping opposing sides of the tube adjacent to the end, and bonding the sides together. Preferably, the bond step forms a seam extending generally across the tube. Preferably, each bond is formed by means of thermoplastic welding.

Preferably, each seam is substantially crescent shaped and extends partially down the corresponding side of the tube. Preferably, the seam defines the respective ends of the tube, which are shaped by trimming or rounding so as to remove any sharp corners.

Preferably, the perforations at each end of the tube are formed in sections, and each section includes a plurality of apertures sized to be sufficiently small to retain the pellets within the tube and sufficiently large to allow passage of liquid through the straw in response to oral suction. More preferably, the apertures take the form of elongate slots formed on opposing sides of the tube.

Preferably, the perforated sections are formed by punching the sidewalls of the tube.

Preferably the pellets are of a predetermined size and shape. Preferably the pellets contain a predetermined measure of soluble active ingredient.

In another aspect, the invention provides a drinking straw adapted progressively to add an active ingredient to a carrier liquid drawn through the straw, said straw including:

a generally elongate tube having a sidewall defining an internal bore and first and second open ends;

a plurality of pellets containing a measure of soluble active ingredient;

first filtration means formed from the sidewall adjacent the first end to retain the pellets substantially within the tube while allowing the carrier liquid to be drawn through the tube by oral suction; and second filtration means adjacent the first end to retain the pellets substantially within the tube while allowing the carrier liquid to be drawn through the tube by oral suction.

Preferably, each filtration means includes at least one aperture sized to be sufficiently small to retain the pellets within the tube and sufficiently large to allow relatively unimpeded passage of liquid.

Preferably, each filtration means includes a blockage or closure of the tube at or adjacent the respective end. The blockage or closure is preferably formed by opposing sides of the tube being pinched and bonded together.

BRIEF DESCRIPTION OF THE DRAWINGS

Preferred embodiments of the invention will now be described, by way of example only, with reference to the accompanying drawings in which.

PREFERRED EMBODIMENT OF THE INVENTION

Figure 1:
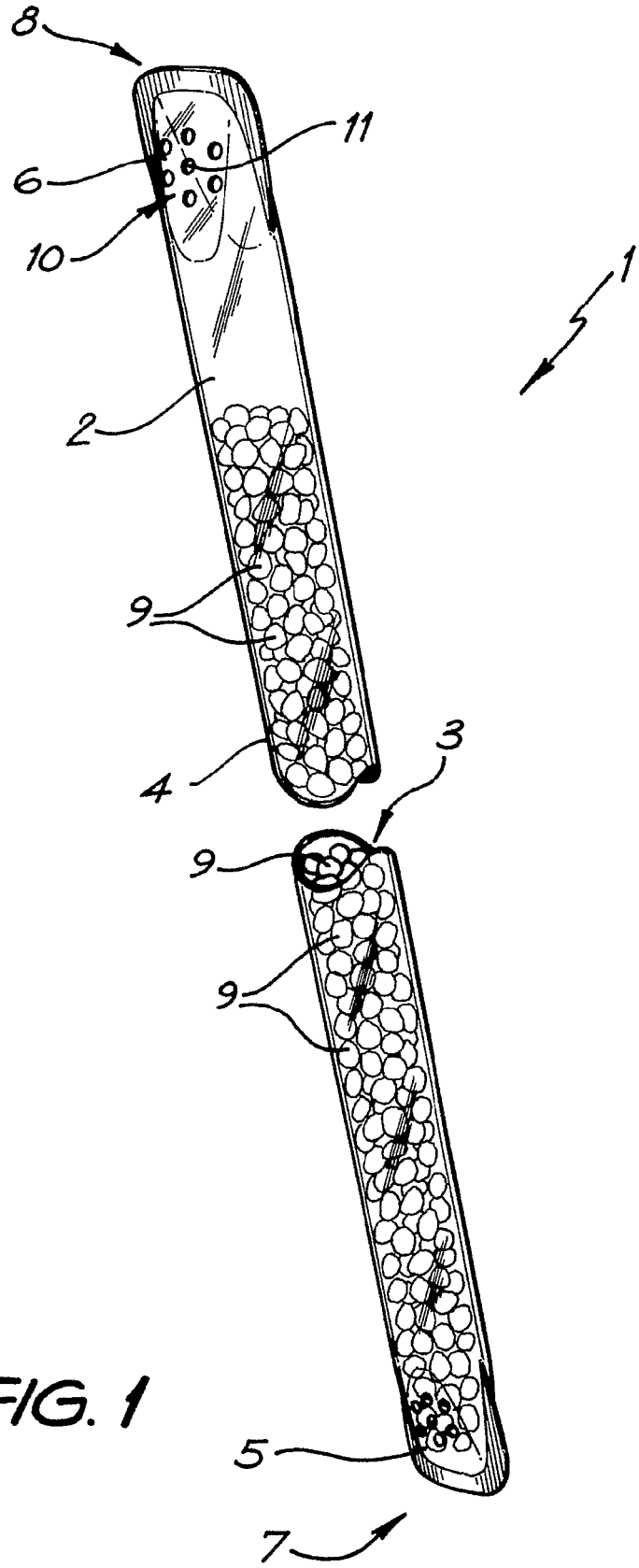
FIG. 1 is a perspective view of a drinking straw containing soluble active ingredients in accordance with the invention.

Referring to the drawings, the invention provides a drinking straw 1 for progressively adding an active ingredient to a carrier liquid as the liquid is drawn through the straw. It will be appreciated that FIGS. 1, 2A and 2B show the straw as being of indefinite length.

Typically, the carrier liquid is a plain beverage such as milk or water, and the active ingredient is a flavouring and/or colouring agent. It should be appreciated, however, that other active ingredients, such as pharmaceuticals, vitamin and mineral supplements, antioxidants, herbal remedies or probiotics, and other carrier liquids, may additionally or alternatively be used.

Figure 2A:
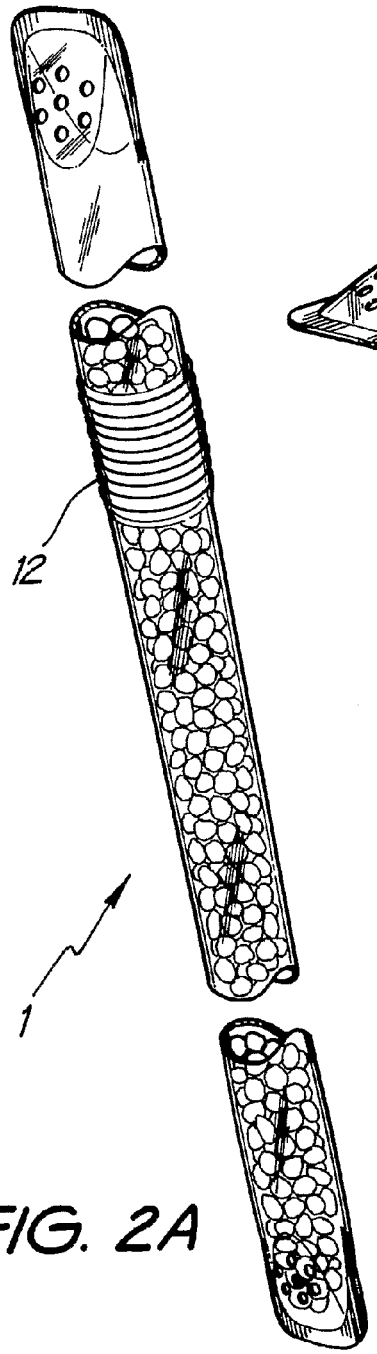
FIG. 2A is a perspective view of another embodiment of the drinking straw having a concertina section, in accordance with the invention.
Figure 2B:
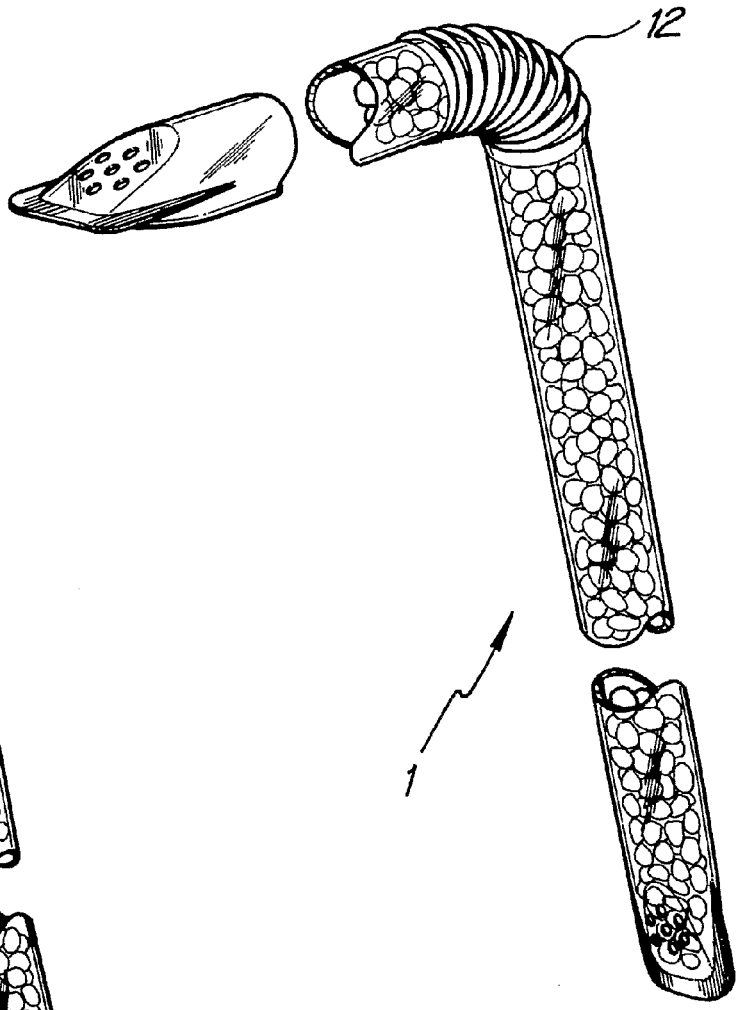
FIG. 2B is a perspective view of the drinking straw shown in FIG. 2A, in a bent configuration.

As can be seen in FIG. 1, the straw 1 includes a generally elongate tubular body 2 having an internal bore 3 and a sidewall 4, adapted for use as a straw. The tube 2 includes first and second filters 5 and 6 disposed at respective first and second ends 7 and 8, of the tube. Together, the first and second filters retain a predetermined measure of soluble active ingredients within the bore of the tube 2, while allowing a carrier liquid to be drawn through the straw, by oral suction. The active ingredient, preferably a flavouring agent, takes the form of a plurality of solid pellets 9. Although generally spherical, in some forms the pellets may be slightly elongated or cylindrical.

The filters 5 and 6 are formed integrally from the respective ends of the tube and as such do not require any additional parts or components. More specifically, each filter is formed by blocking, closing or constricting the tube at or adjacent the corresponding end and providing at least one aperture sized to be sufficiently small to retain the pellets within the tube whilst sufficiently large to allow passage of liquid.

In the preferred embodiment, each open end of the tube is blocked by pinching it flat, so that the opposing sides are brought together. Once in contact, the sides are bonded together, thereby effectively closing the end of the tube. The aperture takes the form of a perforated section 10 of the tube. Each perforated section 10 includes a plurality of apertures 11 disposed in an array on each side of the tube.

The invention also extends to a method of manufacturing the drinking straw. In very general terms, the method includes steps of forming a tube of a predetermined length and size, forming a first end of the tube into the first filter; depositing the predetermined amount of active ingredient in the form of pellets within the tube; and forming the other, second end of the tube into the second filter, so as to encapsulate the pellets within the tube. It will be appreciated that in the embodiment of the invention as illustrated, the perforations may be formed either before or after the pellets are added. A concertina section in the tube may also be provided.

A more detailed description of one particular embodiment of the straw and its preferred method of manufacture follow.

Figure 3A:
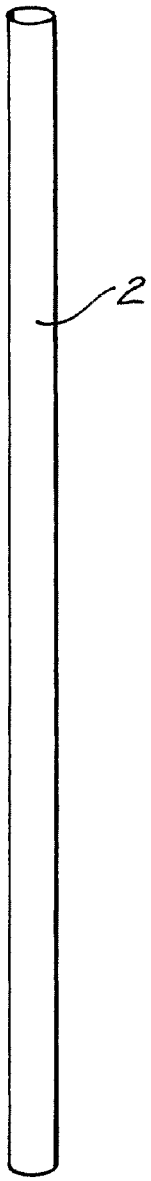
FIG. 3A is a pictorial view of a tube used to form the straw in accordance with the invention.

As shown in FIG. 3A, the tube used to form the straw is a cylindrical extrusion, ideally of a food-grade thermosetting plastic. Preferably, the tube has a substantially circular cross section although other extrusion sections may be used, for instance oval, ellipsoid or polygon sections. Furthermore, the plastic is transparent or partially transparent, to allow the user to visually monitor the inside of the straw. In this embodiment, polypropylene is used because it is non-toxic, may be readily heat welded and is available in transparent forms. It will be appreciated, however, that in place of polypropylene, any other form of plastics material, or any other suitable material such as waxed paper, metal foils or the like may be used to form the straw.

In this embodiment, the circular extrusion has an inside diameter of around 5.5 mm and outside diameter of around 6.0 mm, with a wall thickness of around 0.25 mm. The extrusion is cut into lengths of around 200 mm. However, it will be appreciated that the invention is not limited to a straw of these particular dimensions. For instance, in an alternative, larger version, the extrusion has an inside diameter of 10 mm and outside diameter of 11 mm, with a wall thickness of 0.5 mm and a straw has a length of 20 mm.

Figure 3B:
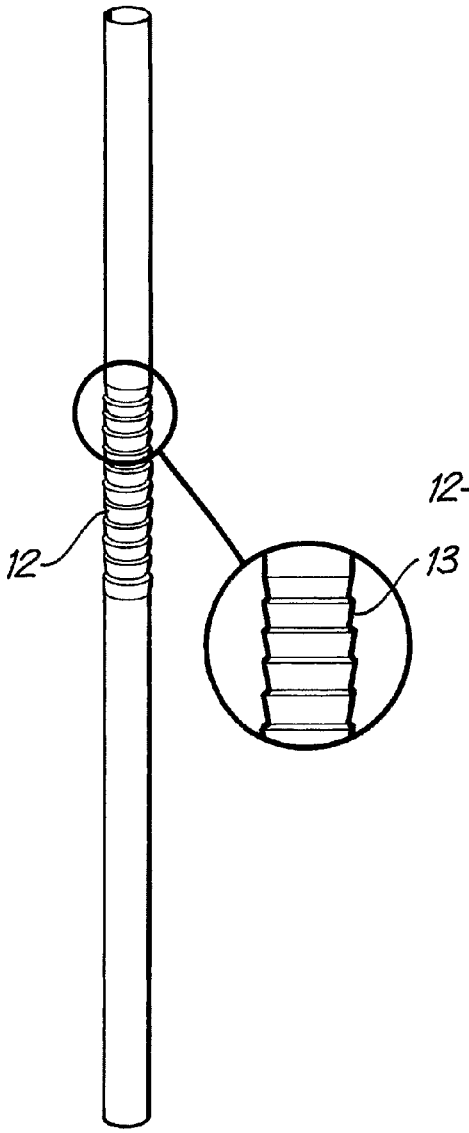
FIGS. 3B and 3C are pictorial views of the tube showing the concertina section to being formed therein.
Figure 3C:
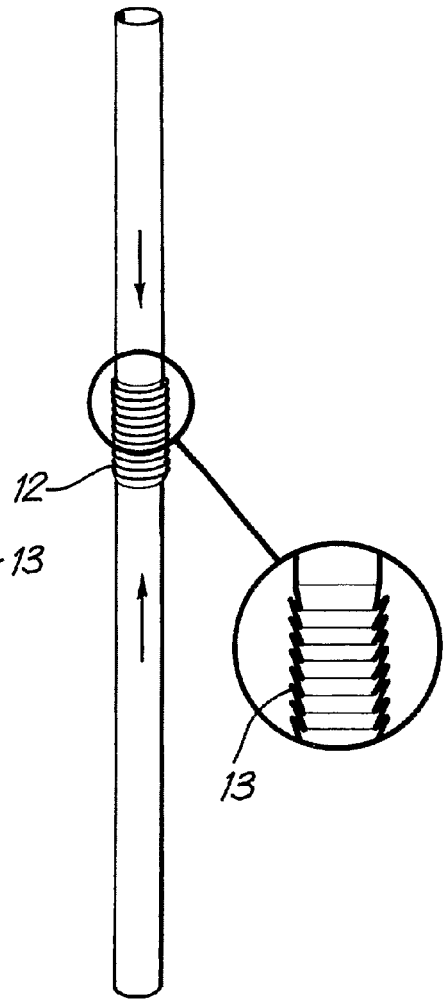

Referring to FIGS. 3B and 3C, the first stage of transforming the tube into the drinking straw is to form the concertina section 12 in the tube sidewall. The concertina section 12 includes an array of circumferential ribs 13 formed in a saw-tooth profile, which allow the straw to be extended or bent whilst maintaining continuity of the internal bore.

It will be appreciated that formation of the concertina section is entirely optional. Its inclusion allows bending of the straw to provide adjustment of the inclination of the mouth end of the straw for ergonomic drinking. In addition, it provides the straw with the ability to be bent back over 90° to shorten its overall length. This is advantageous in one application, where the straw is packaged on the side of a container of fixed dimensions, because it allows for packaging of a straw longer than the container. However, this advantage along with methods of forming the concertina section are well known in the art.

Figure 3D:
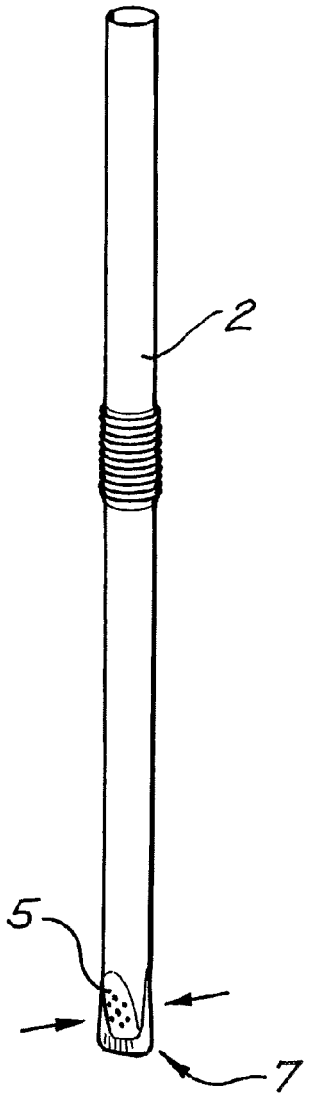
FIG. 3D is a pictorial view depicting the formation of a first filter at a first end of the tube.

Next, as shown in FIG. 3D, the first end 7 of the tube 2 is formed into the first filter 5 in a three-stage procedure. The end 7 of the tube is clamped flat and the tube sidewalls are bonded together by heat welding of the thermosetting plastic sidewall. The perforated sections are formed by punching or piercing apertures in the sidewalls of the tube, toward the corresponding end. The end of the straw is then trimmed or otherwise smoothed around the weld to shape the straw and eliminate any sharp corners or protrusions that could potentially cause oral discomfort to the user. These three steps may be performed substantially simultaneously, or in almost any order. For instance, it is possible to first clamp the tube, punch the holes and trim the corners, before bonding the sides together.

Figure 4:
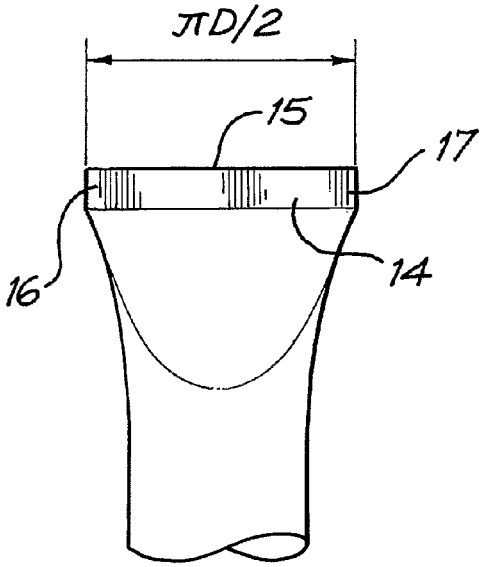
FIG. 4 is an enlarged view showing the end of the tube incorporating a simple transverse weld in accordance with the invention.

In a simple form, as shown in FIG. 4, weld 14 is substantially straight, extending transversely across the end of the tube in a direction normal to the longitudinal tube axis. Blocking the tube in this way provides an advantage when the straw is used with carrier liquids packaged in the type of cartons which include a frangible membrane, positioned and sized on the carton to be pierced by, and subsequently to accommodate, a correspondingly sized drinking straw. Conventional straws used in this context are obliquely cut, so as to provide a sharpened end adapted to facilitate piercing of the carton membrane. However, in place of the sharpened end, the present invention provides the straw with an end having a bonded double layer of sidewall material. This double layer forms a relatively stiff edge 15, well adapted for piercing the carton's frangible membrane.

As can be seen in FIG. 4, pinching the tube and welding in this way results in an increase in width of the tube at the end to approximately $\pi/2$ times the width, or around 50%, of the original diameter. The increase in width can be seen as both an advantage and a disadvantage. On the one hand, the increased width may result in the end of the straw being too wide to easily fit and pass through the circular aperture surrounding the carton membrane, which is usually sized and shaped according to the nominal diameter of the straw. On the other hand, provided the wider end fits within the confines of the frangible area, the wider end may provide an advantage since it tends to open a pair of slit extensions on either side of the hole formed by the straw piercing the frangible membrane. These slits provide breathing holes to allow air to enter the carton as fluid is removed.

In addition, pinching and welding the end of the tube results in the formation of relatively sharp corners 16 and 17 which may cause discomfort when placed in the mouth of the user.

Figure 5:
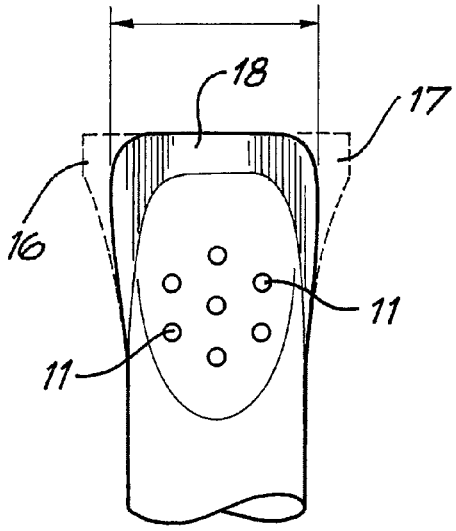
FIG. 5 is an enlarged view of the end of the straw shown in FIG. 1.

For this reason, in the embodiment of the invention shown in FIG. 5, the corners 16 and 17 are trimmed off and rounded to eliminate sharp corners and reduce the width of the end of the tube. The degree of trimming is selected to balance the requirement for a reduced straw width with the above mentioned advantage of breathing hole formation.

As a further variation, as shown in FIG. 5, rather than extending directly across the straw, the weld 18 may be formed in an inverted-U or crescent shape, extending partially along the outer edges of the straw, parallel to the longitudinal axis. The crescent-shaped weld 18 seals the edges of the straw which may otherwise be open as a result of the corners being trimmed, and in addition, provides enhanced stability and structural integrity for the straw end, which is advantageous when piercing the frangible carton membrane.

Figure 6:
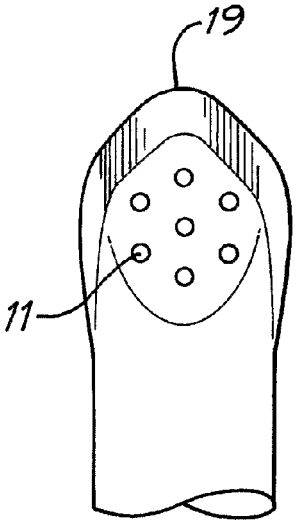
FIGS. 6 and 7 are enlarged views of the ends of alternative embodiments of the straw in accordance with the invention.
Figure 7:
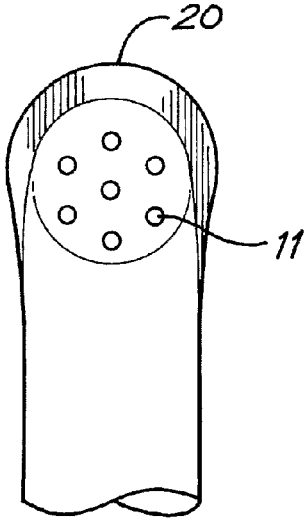

Of course the welding and clipping of the ends of the tube is not limited to the shapes shown in FIGS. 4 and 5. Alternative shapes are shown in FIGS. 6 and 7, which provide the same advantages as the straw shown in FIG. 5, but with pointed or rounded ends 19 and 20 respectively, to further assist in piercing the carton membrane.

Several other alternatives or additions may also be applied. For instance, a variety of methods, other than heat welding, may be used for bonding the sidewalls of the tube together including the use of adhesives, plastic welding, ultrasonic welding, or any other suitable method.

In addition, rather than pinching and welding, alternative methods of closing the end of the tube may be used. For instance, the tube may be blocked by crushing, crimping, folding, by slitting the end of the tube to create a number of flaps and then folding the flaps together, or any other suitable method or combination.

A selection of some possible alternative methods for sealing the end of the tube are shown in FIGS. 8 to 12.

Figure 8:
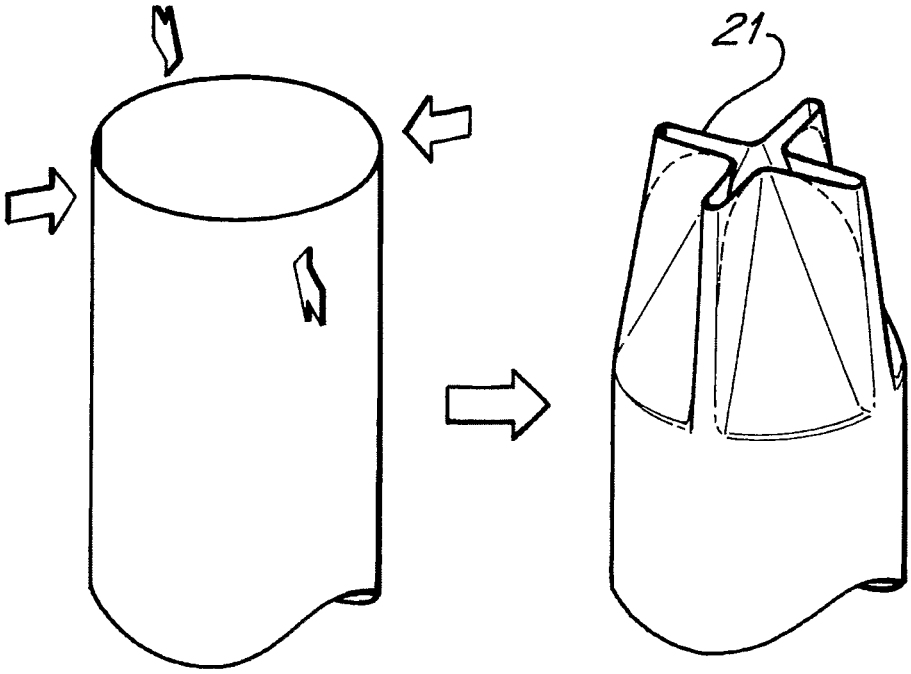
FIGS. 8 to 12 are enlarged views of the end of a tube in accordance with alternative embodiments of the invention.

In FIG. 8, the tube end is pinched and welded together on four rather than two sides. This forms a star shaped end 21 which may be trimmed to remove sharp corners.

Figure 9:
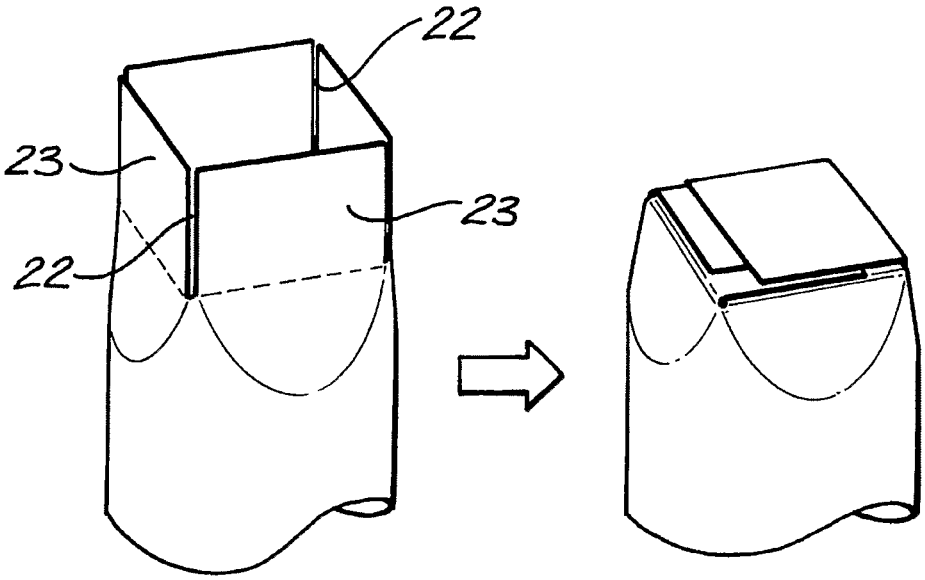

In FIG. 9 four circumferentially spaced, longitudinal slits 22 are made in the end of the tube. These slits divide the tube end into four flaps 23 which may be folded inwardly and sealed together, thereby closing or partially closing the opening and giving the end of the tube a square profile.

Figure 10:
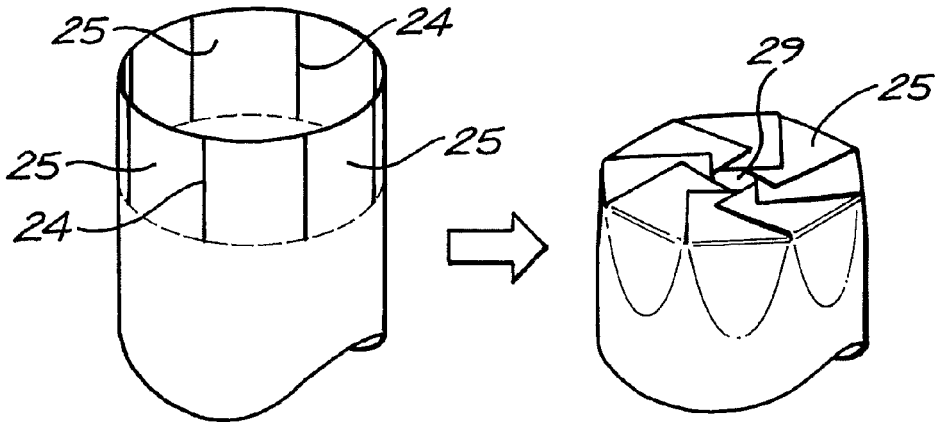

A similar approach has been taken in the embodiment shown in FIG. 10. Here, a plurality of slits 24 are used to divide the tube end into a plurality of flaps 25 that are folded inwardly. While more complex, this provides a more circular profile to the end of the tube than that of the embodiment shown in FIG. 9.

Figure 11:
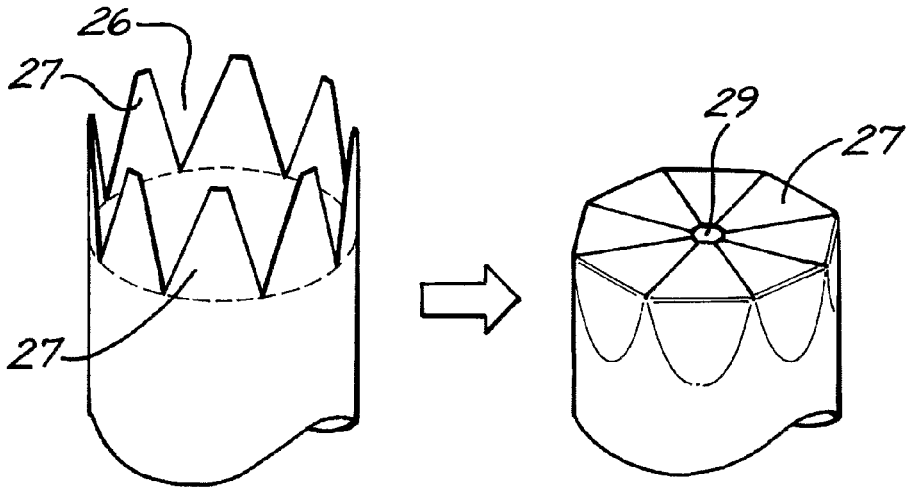

In FIG. 11, an array of V-shaped notches 26 have be cut in the end of the tube. The notches divide the tube end into triangular flaps 27 that are folded inwards to meet along adjacent respective edges.

Figure 12:
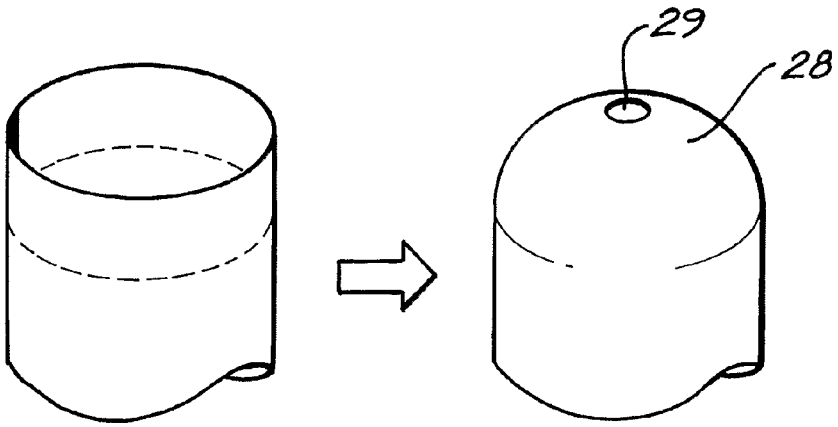

In FIG. 12 the end of the tube is heated and crimped inwardly to form a rounded or domed tube end 28.

In still other embodiments, the ends of the tube are not completely blocked but are constricted. That is, the ends are only partially closed, such that one or more apertures remain in the end of the straw. This may be accomplished by providing a seal or weld that does not extend fully, or is discontinuous, across the straw. For instance it will be noticed that a central aperture 29 remains in the embodiments shown in FIGS. 10 to 12. Either way, any apertures of openings resulting from partial constriction of the ends of the tube are sized and shaped to retain the pellets within the straw whilst allowing relative unimpeded passage of liquid. These constriction type apertures may provide the only fluid passages through the respective filters, or be used in addition to, and in conjunction with, the apertures formed in the sidewall of the tube by piercing, perforation or other means, as previously described. In this regard, the apertures 11 which form the perforated sections 10 may be circular holes, as shown in the figures, or any other suitable shape including any combination of holes, slits or slots. It will be appreciated that the shape and size of the holes will be dictated to a large degree by the shape and size of the pellets.

For instance, one advantage of providing elongate slots in conjunction with spherical pellets is that the dissimilarity in shape tends to prevent the pellets from blocking or clogging the slotted apertures as they dissolve. Rather, when the pellets dissolve to a predetermined suitably small diameter, they are able to pass through the slotted apertures and out of the straw, to be safely ingested by the consumer. This tends to reduce the possibility of blocking of the filters and accordingly, fluid flow is maintained at all times, while premature consumption of coarse flavouring particles is also avoided. The apertures may be placed in discrete arrays on either side of the tube, as depicted in the drawings, or in any other regular or irregular arrangement at or adjacent the end of the tube.

In this embodiments the invention as illustrated, the apertures are punched through both sidewalls of the straw whilst it is clamped, with a male punch and a corresponding female die. This operation may be performed along with the trimming and bonding operations. Alternatively, the apertures may be formed by piercing the sidewalls with a lance. The lance may be heated to melt the plastic sidewall.

Figure 3E:
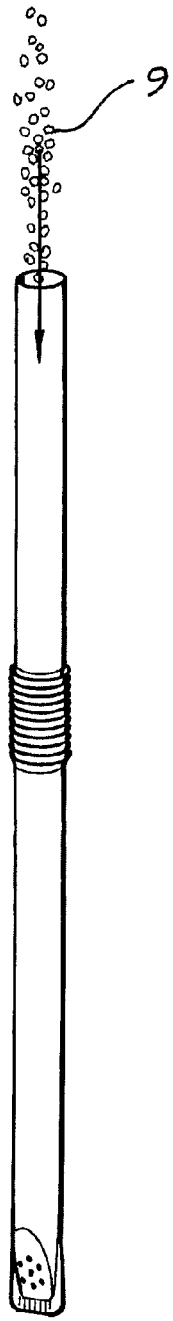
FIG. 3E is a pictorial view showing the active ingredient being added inside the tube.
Figure 3F:
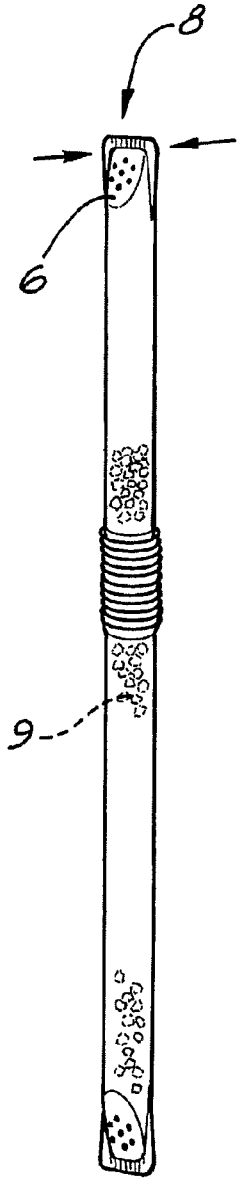
FIG. 3F is a pictorial view showing the formation of a second filter at the second end of the straw.

Returning to FIG. 3E, once the first filter 5 of the straw is formed at the first end of the tube 7, the pellets 9 are added. The tube 2 is held in a generally upright orientation, so that the first filer is positioned below the open end 8 of the tube. The pellets may be added to the tube via this top open end. Filling may be vacuum assisted.

The predetermined volume of pellets 9 contained within the tube is calculated to be sufficient for the volume of beverage with which the straw is intended to be sold or used. This particular straw has been configured to be used with relatively smaller volumes of liquid than those shown for instance in WO 98/15187. However, as previously noted, in alternative embodiments, the straw may be manufactured in larger or even smaller sizes, with corresponding volumes of active ingredient as required. In cases where pharmaceuticals or vitamin supplements are included, the volume of pellets used will be dictated by the concentration of the active ingredient, and the required dosage.

Once a predetermined amount of pellets has been added to the tube, the second end 8 of the tube is formed into the second filter 6. This may be accomplished in the same manner as described above in relation to the formation of the first filter 5.

In other embodiments, the filter in each end of the straw may be formed differently. For instance, only one end of the tube may be formed into an integral filter, while the filter at the other end of the straw may be formed by the addition of a discrete filter element, such as that described in WO 98/15187.

The concentration of active ingredient in the liquid exiting the straw is dependant upon: the size; shape and number of pellets used in the straw; the "dwell time" within the straw; the concentration of active ingredient in the pellets and the effective dissolution rate of each pellet as well as external influences such as; temperature; humidity and carrier liquid properties, composition and viscosity.

In terms of controllable properties, the spherical shape pellet is advantageous because it not only provides a predicable and steady rate of dissolution, it also enhances the flow characteristics of the pellets in bulk form in order to facilitate filling of the straw during production. Furthermore, the spherical shape is resistant to crushing and fragmentation thereby reducing the amount of powder in the straw, which may prematurely dissolve or be ingested by the user.

In some cases, however, spherical pellets may be costly to manufacture and accordingly, in alternative embodiments, the pellets may be non-spherical, for example elongate, prolate spheroid, cylindrical or in tablet or capsule form. For instance in a particular embodiment, the pellets are formed by extrusion resulting in pellets having a generally regular prism or cylindrical shape whether the cross section be circular, oval or otherwise.

The size of the pellets not only alters surface area but also affects the dwell time of the liquid within the straw. Large pellets will provide looser packing giving larger spaces between the pellets and a more direct route for liquid passing through the straw. Accordingly, larger pellets generally result in a reduced dwell time and increased flow rate for a given suction pressure. However, if the pellets are made too large with respect to the internal diameter of the straw, they can block the passage substantially or completely, or provide in adequate surface area.

Accordingly, the pellets are sized so as to be complementary with respect to the width and shape of the straw cross-section. Generally, given a circular straw and spherical pellets, the pellets have a diameter between 10% and around 80%, more preferably between 15% and 70%, and most preferably between 20% and around 50% of the internal diameter of the straw but ideally no larger than half the internal diameter. It has been found through painstaking development and testing that with this combination, the pellets have appropriate combined surface area to ensure adequate flavour infusion, and are retained until substantially dissolved, yet do not result in clogging of the filters. It will be appreciated, that under real world conditions, the formation of perfectly spherical pellets are unlikely. In such cases the above dimensions are given as a guide to be interpreted within the bounds of the art.

In the case of non-spherical pellets and tubes previously disclosed, appropriate selection of the size of the pellets in relation to the tube diameter should be applied. However, as a general rule when close packed, the ratio of volume of pellets to volume of interstitial void should be no more than 4.5 to 1 and preferably less than 3.5 to 1 and more preferably less than 3 to 1.

Two other important factors effecting the concentration of active ingredient in the carrier liquid exiting the straw are the concentration of the active ingredient within the pellets and the dissolution rate of the pellet itself. A highly concentrated pellet will impart a higher concentration of active ingredient to the carrier liquid. Similarly, a pellet, which dissolves more readily, will also provide a higher exit concentration of active ingredient, all other variables being equal. In this respect, the straw is intended to be a disposable, single use item. The dissolution rate of the pellets is selected to match a particular volume of milk or other beverage, such that once that prescribed volume has passed through the straw, the pellets will have dissolved completely or to such an extent that they are small enough to pass through the apertures in the filters and exit the straw. At this stage, the transparent wall of the straw will allow the user to identify that the straw is devoid of pellets and is ready to be discarded. In one particular embodiment, the spherical pellets of the invention are ideally in the form of "nonpareil" balls, which enables close control of the above variables in comparison to other shapes and methods of manufacture.

Nonpareil balls are formed by building up a plurality of layers on a "seed". Typically, this seed will be a sugar crystal. However, any other suitable nuclei may be used. Nonpareil pellet formation allows the size of the pellet to be controlled and ensures that shape is generally spherical. Furthermore, the composition of the pellet can be adjusted layer by layer. Layers of active ingredients including flavouring, sweetener or sugar, colouring, starch and pharmaceuticals and vitamins and minerals can be alternated in any order, as required.

This enables active ingredient concentration, and dissolution rate to be varied throughout the cross section of the ball. For instance, by providing a pellet with a high concentration of flavouring toward the centre, a relatively uniform infusion rate can be achieved, even as the pellet progressively reduces in size and its surface area is diminished.

Furthermore, by way of example, flavours may also be mixed or changed so that one flavour is added to the beverage initially, and is subsequently replaced by another flavour as the pellets dissolve. The change in flavour may be accompanied by a change in colouring of the pellets and the user may identify this change through the transparent or translucent side wall of the straw. Artificial sweetener may also be used to sweeten the beverage or carrier liquid as it passes through the straw. It will also be appreciated that by providing a mixture of pellets of different composition, a multitude of flavours or other active ingredients can be infused simultaneously, rather than sequentially.

While, the straw of the invention may be packaged and sold as individual items or in multiple packs, it is also envisaged that the straw be sold along with a carton, container or bottle of beverage such as milk, or mineral water. The straw, initially packaged within a surrounding hygienically sealed disposable wrapper (not shown) is affixed to the outside of the carton, in the same manner used with conventional straws. This method conveniently packages the straw and beverage together. The user detaches the straw at the point of consumption, removes it from the wrapper and uses one of the ends to pierce the frangible membrane on the carton. The straw is then inserted into the carton through the resultant opening, and the beverage may then be consumed through the straw.

It will be appreciated that a particular embodiment of the invention has been developed in order to add flavouring to drinks such as milk, soy milk, mineral and carbonated waters, sodas, soft drinks, milkshakes, cordials, juices, alcoholic beverages, and the like, however the invention may equally be applied to add sweeteners, vitamin supplements, nutritional, herbal, pharmaceutical, health and energy additives to liquids for ingestion. In such cases, the transparent sidewalls of the straw are particularly advantageous for assessing that the correct dosage of the agent has been administered. This may be indicated by an empty straw or, as an encouragement to potentially reluctant children, a visible colour or discernible flavour change in the pellets.

Advantageously, the invention provides the user with a degree of control over the intensity of the flavouring, according to the rate at which the beverage is sucked through, and hence the dwell time of the liquid within, the straw. It has also been found that by only partially filling the straw with flavouring pellets, the resultant free space provides for enhanced agitation of the pellets and hence improved mixing. This in turn results in a more uniform distribution of flavouring within the beverage as the agitated pellets perform a stirring function.

Additionally, because the active ingredient is sealed in a dry form, the product generally has a markedly superior shelf life to products where the ingredient is contained in liquid form. For instance, in the case of flavouring agents, the invention permits the sale of a relatively inexpensive unflavoured beverage together with an effective flavouring agent integrated with a straw, it is envisaged that retailers will be able to achieve substantially enhanced profit margins over the current form of sale of both flavoured and unflavoured beverages, and particularly milk. The consumer is provided with a greater variety of flavour selection, optionally involving the combination of a number of different flavours, and the possibility of applying the flavouring at any desired concentration. Also, because the flavouring component of the beverage will normally have a longer shelf life, particularly in the case of milk, if any unused product needs to be discarded, wastage of the flavouring component at least can be avoided. Further, because the retailer can optionally stock a relatively large number of plain beverages in the available refrigeration space, with the flavouring receptacles stored elsewhere, stock and inventory control can be greatly simplified.

Similar benefits apply to other active ingredients such as pharmaceuticals and health and nutritional supplements.

The invention is also particularly advantageous in the administration of soluble oral pharmaceuticals and other medical treatments to young children and the elderly, who often have difficulty swallowing such medicaments in conventional tablet or capsule form.

Furthermore, it will be appreciated that the invention provides a comparatively low cost method of producing a drinking straw containing soluble agents in comparison to that described in WO 98/15187. It achieves this advantage by eliminating the need to assemble the straw from multiple components, each of which must be manufactured separately, which is possible because the filtration elements are formed integrally from the tubular body of the straw. In these and other respects, the invention represents a practical and commercially significant improvement over the prior art.

Although the invention has been described with reference to specific examples, it will be appreciated by those skilled in the art that the invention may be embodied in many other forms.

The invention claimed is:

1. A method of manufacturing a drinking straw adapted progressively to add an active ingredient to a carrier liquid drawn through the straw, said method including the steps of:

providing a generally elongate tube having a sidewall defining an internal bore and first and second open ends;

providing a first filtration means adjacent the first end of the tube;

depositing a plurality of pellets containing a measure of soluble active ingredient into the tube through the second end; and providing second filtration means adjacent the second end of the tube, wherein said first and second filtration means retain the pellets substantially within the tube whilst allowing the carrier liquid to be drawn through the tube by oral suction and wherein at least one of said filtration means is provided by forming the sidewall adjacent the respective end of the tube into filtration means by pinching and welding together the tube to form more than two sides and to at least partially block the tube.

2. A method according to claim 1 wherein the steps of providing first and second filtration means includes the steps of:

at least partially blocking the respective open end; and providing a perforated section at the respective end including at least one aperture sized to be sufficiently small to retain the pellets within the tube and sufficiently large to allow passage of liquid through the straw in response to oral suction.

3. A method according to claim 1 including the step of clipping the end of the tube to remove sharp corners.

4. A method according to claim 1 wherein the step of forming the filtration means includes:

at least partially blocking the respective open end; and providing a perforated section formed from the sidewall at the respective end including at least one aperture sized to be sufficiently small to retain the pellets within the tube and sufficiently large to allow passage of liquid through the straw in response to oral suction.

5. A method according to claim 4 wherein an open end of the tube is at least partially blocked by clamping opposing sides of the tube adjacent said end and bonding the opposing sides together.

6. A method according to claim 5 wherein, bonding the sidewall forms a seam extending generally across the tube.

7. A method according to claim 6 wherein, the seam is substantially crescent shaped and extends partially down opposing sides of the tube.

8. A method according to claim 6 wherein, the seam defines the end of the tube, and is shaped by trimming so as to remove sharp corners.

9. A method according to claim 6 wherein, bonding is achieved by means of thermoplastic welding.

10. A method according to claim 4 wherein the perforated section includes a plurality of said apertures.

11. A method according to claim 10 wherein the apertures are formed in a regular array.

12. A method according to claim 10 wherein the apertures are formed on opposing sides of the tube.

13. A method according to claim 4 wherein the apertures are slots.

14. A drinking straw adapted progressively to add an active ingredient to a carrier liquid drawn through the straw, said straw being manufactured in accordance with the method of claim 1.

15. A drinking straw adapted progressively to add an active ingredient to a carrier liquid drawn through the straw, said straw including:

a generally elongate tube having a sidewall defining an internal bore and first and second open ends;

a plurality of pellets containing a measure of soluble active ingredient;

first filtration means formed from the sidewall by pinching and welding together the tube to form more than two sides and to at least partially block the tube at the first end to retain the pellets substantially within the tube while allowing the carrier liquid to be drawn through the tube by oral suction; and second filtration means by pinching and welding together the tube to form more than two sides and to at least partially block the tube at the second end to retain the pellets substantially within the tube while allowing the carrier liquid to be drawn through the tube by oral suction.

16. A drinking straw according to claim 15 wherein, each filtration means includes at least one respective aperture sized to be sufficiently small to retain the pellets within the tube and sufficiently large to allow passage of liquid.

17. A drinking straw according to claim 15 wherein the first sidewall is bonded together by thermoplastic welding.

18. A drinking straw according to claim 15 wherein the end of the tube includes a rounded profile.

* * * * *